US012674578B2

(12) United States Patent
Lane et al.

(10) Patent No.: US 12,674,578 B2
(45) Date of Patent: Jul. 7, 2026

(54) HYDRONIC SURFACE HEATER WITH AUTO-ADJUSTING BURNER

(71) Applicant: Wacker Neuson America Corporation, Menomonee Falls, WI (US)

(72) Inventors: John Lane, Hartford, WI (US); Andrew Hensch, West Allis, WI (US); Andrew Gastrow, Wauwatosa, WI (US); Donald Duffek, Hartford, WI (US)

(73) Assignee: Wacker Neuson America Corporation, Menomonee Falls, WI (US)

( * ) Notice: Subject to any disclaimer, the term of this patent is extended or adjusted under 35 U.S.C. 154(b) by 577 days.

(21) Appl. No.: 18/096,774

(22) Filed: Jan. 13, 2023

(65) Prior Publication Data

US 2024/0240790 A1 Jul. 18, 2024

(51) Int. Cl.

| | |
|---|---|
| ***F23N 5/00*** | (2006.01) |
| ***F23N 5/18*** | (2006.01) |
| ***F24H 1/18*** | (2022.01) |
| ***F24H 9/00*** | (2022.01) |

(52) U.S. Cl.

CPC ..... *F23N 5/18* (2013.01); *F23N 5/006* (2013.01); *F24H 1/186* (2013.01); *F24H 9/0094* (2013.01); *F23N 2005/181* (2013.01); *F23N 2225/10* (2020.01); *F23N 2235/06* (2020.01); *F23N 2235/16* (2020.01)

(58) Field of Classification Search

CPC . F23N 5/006; F23N 5/18; F24H 1/186; F24H 9/0094

USPC ..... 431/76

See application file for complete search history.

(56) References Cited

U.S. PATENT DOCUMENTS

| | | | | |
|---|---|---|---|---|
| 3,633,563 | A * | 1/1972 | Osborn | E01C 23/06 126/343.5 A |
| 6,453,720 | B1 * | 9/2002 | Tomisawa | F02D 41/1494 73/1.06 |
| 2009/0117505 | A1 * | 5/2009 | Okayasu | F24H 1/08 432/221 |
| 2012/0180778 | A1 | 7/2012 | Krause et al. | |
| 2014/0216437 | A1 | 8/2014 | Martian et al. | |

OTHER PUBLICATIONS

Hydronic Surface Heater E2200/E3000ES Operator's Manual, 2017.

* cited by examiner

*Primary Examiner* — Avinash A Savani
(74) *Attorney, Agent, or Firm* — Boyle Fredrickson, SC

(57) ABSTRACT

A surface heater automatically adjusts the supply of fuel and/air to the burner in order to maintain a desired air/fuel ratio despite changes in ambient air temperature and/or pressure. The adjustment may be performed on a periodic or continuous basis and on either an open-loop basis or a closed-loop basis. The adjustment includes actuating one or more control devices that control the flow of air and/or fuel to the burner. If the adjustment is performed on a closed-loop basis, signals from a sensor can be used as feedback to control the flow of air and/or fuel into the burner to maintain a setpoint of a controlled parameter. The controlled parameter may include one or more of air mass flow rate, an intake $O_2$ concentration, an exhaust $O_2$ concentration, an exhaust gas composition, and an exhaust gas temperature.

20 Claims, 4 Drawing Sheets

HYDRONIC SURFACE HEATER WITH AUTO-ADJUSTING BURNER

BACKGROUND OF THE INVENTION

Field of the Invention

The present invention generally relates to hydronic surface heaters and, more particularly, relates to a hydronic surface heater having a burner whose operation is adjusted automatically to accommodate changes in ambient air conditions in order to maintain a desired air/fuel ratio. The invention additionally relates to a method of operating such a burner.

Discussion of the Related Art

In northern climates, frozen ground is a problem for the construction industry during the winter months. Cold winter temperatures can cause water and sewer pipes to freeze. Frozen ground also interferes with any earth moving operation such as trenching, excavating for foundation footings, leveling for a concrete slab, or digging a gravesite. Further, after concrete footings and a slab are poured, there is a need to heat the concrete to properly cure it. Once a building shell is erected, heat is needed to elevate temperatures within the unfinished structure for the protection of workmen and for curing or drying finishing processes that take place inside the building shell. Consequently, in northern climates, mobile ground heating or thawing systems are known.

One common type of mobile heating system comprises a burner and a fan for discharging large volumes of heated air into a temporary enclosure that confines the heated air above the area which is to be thawed. Such systems are also used to blow heated air into an unfinished structure during later phases of construction. However, when such systems are used in this latter application, they are found to have a significant problem with water vapor, carbon dioxide, and other combustion products, which build up inside the unfinished structure. It is not desirable to expose workmen for many hours to the combustion products which emanate from such devices. Further, since water vapor is one of the principal byproducts of combustion, condensation of the water vapor in the structure can be a problem in cold weather. Such systems are also known to have a low thermal efficiency and are expensive to run because of high fuel consumption.

Another type of mobile ground heating or thawing system, known as a "hydronic surface heater", includes a boiler or tank, a pump, and a ground heat exchanger in the form of a hose through which a heat transfer fluid is circulated, typically a propylene glycol solution. The hose is unwound from a reel and laid out in a pattern on the surface area to be heated. The heat transfer fluid is pumped from the boiler through the hose, which transfers heat to the ground surface, and then back through the boiler. Hydronic surface heaters are known to have better heat transfer efficiency than those employing a burner and a fan. Such systems also provide the advantage of being able to apply heat more precisely to a desired area.

The burners of such surface heaters systems typically are calibrated to operate most efficiently under designated operating conductions, such as a temperate range of −15 to 50 deg. F. (−10 to 10 deg. C.) at sea level. These settings typically are factory preset and can be changed only by a skilled technician. These burners thus do not automatically adjust their operation to changing ambient air temperatures, even though air temperatures may range from −25 to 75 deg. F. (−30 to 25 deg. C.). They also do not automatically adjust to barometric air pressure changes due to changes in elevation or even weather conditions at a particular elevation. Ambient barometric pressure can drop from 14.7 psi (101 kPa) at sea level to 11.8 psi (81 kPa) at 5000 feet (1525 in). The burner's air/fuel ratio can become either lower or higher than optimal as ambient temperature and/or pressure deviate(s) from the nominal or preset values. Burner operation with low air/fuel ratios can result in excess smoke, which may result in noncompliance with emission requirements and even damage the equipment. Burner operation with high air/fuel ratios can result in high NOx emissions and excess flameouts of the burner, causing equipment shutdowns. Transporting a trained technician to the field to adjust burner settings can be expensive and time consuming, resulting in the need for system shut down or risking failure while waiting for the technician. Moreover, the adjustment also may be merely a temporary solution to the problem in environments subject to rapid, extreme, and/or frequent temperature changes.

The need therefore has arisen to provide a hydronic surface heater or similar burner-equipped mobile machine whose operation is adjusted automatically with changing ambient air conditions in order to maintain a desired air/fuel ratio.

SUMMARY OF THE INVENTION

According to one aspect of the invention, a surface heater automatically adjusts the supply of fuel and/or air to the burner in order to maintain a desired air/fuel ratio. The adjustment may be performed on a periodic or continuous basis. It also may be performed on an open-loop basis or, more typically, on a closed-loop basis by comparing a calculated air/fuel ratio or a value indicative thereof to a desired value. The adjustment may include actuating one or more control devices that are operated by a controller to control the flow of air and/or fuel to the burner.

If the adjustment is performed on a closed-loop basis, the control device is operated to maintain the controlled parameter at a setpoint, resulting in maintaining burner operation at the desired air/fuel ratio. The control device may can be a damper position adjuster that adjusts the position of a damper located in an inlet path of the burner and/or a fuel flow adjuster, such as a proportional control valve, that controls the rate of fuel flow into the burner. In this case, signals from an air mass flow rate sensor, an intake $O_2$ sensor, an exhaust $O_2$ sensor, an exhaust gas composition sensor such as a smoke sensor, an exhaust gas temperature sensor and/or another sensor can be used as feedback to maintain the controlled parameter setpoint. The controlled parameter setpoint that is determined to correspond to the desired air/fuel ratio at any given combination of ambient air pressure and ambient air pressure can be determined using an empirically generated stored map that indicates an air/fuel ratio for each of a plurality of values of the controlled parameter at each of a plurality of combinations of air ambient temperatures and pressures.

The controller may be configured to control for a first desired air/fuel ratio at burner startup and a second air/fuel ratio during steady state burner operation. Both the first and second air/fuel ratios may be preset. Alternatively, the first air/fuel ratio may be variable, and may be dependent on detected ambient air temperature and detected ambient air pressure.

Also disclosed is a method of controlling the burner of a surface heater to maintain a desired air/fuel ratio despite changes in ambient air temperature and ambient air pressure.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. The invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

A specific exemplary embodiment of the invention now will be described in the form of a mobile hydronic surface heater that is equipped with a liquid fuel-fired burner. It should be understood that the air/fuel control concepts discussed herein apply equally to other stationary and mobile heaters with liquid-fuel fired burners.

Figure 1:
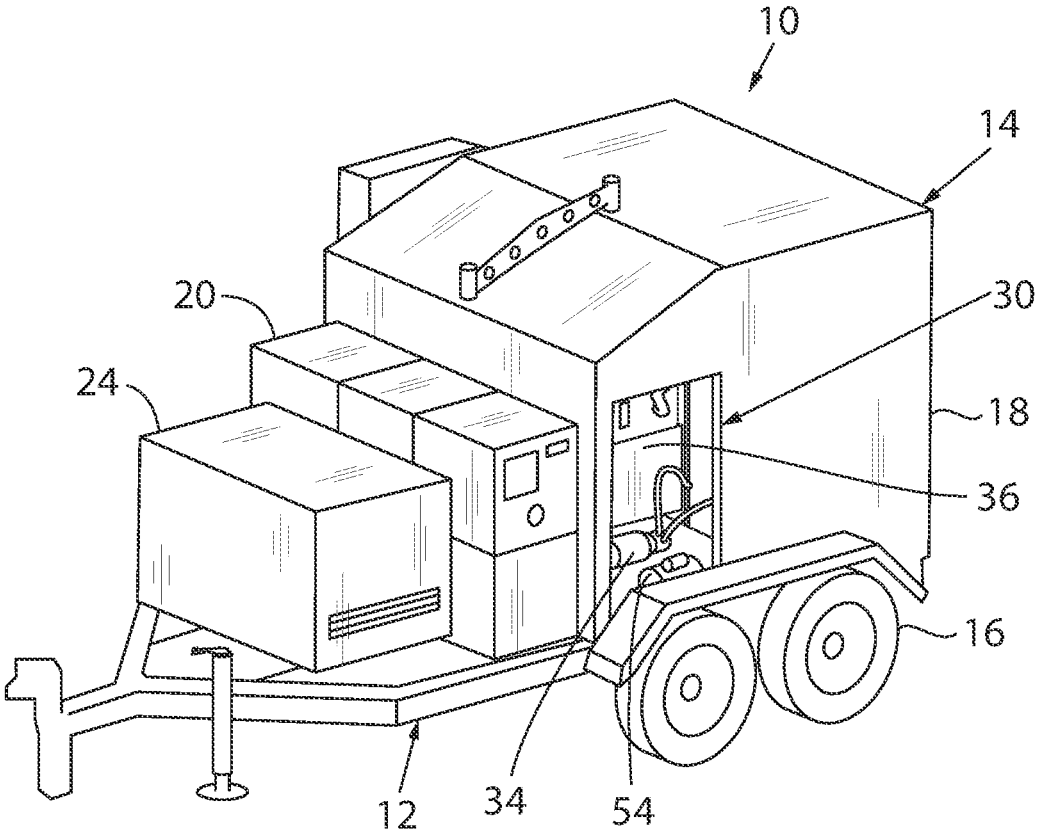
FIG. 1 is a front perspective view of an embodiment of the present invention in the form of a trailer supported hydronic surface heater equipped with an air/fuel control system for the heater's burner.
Figure 2:
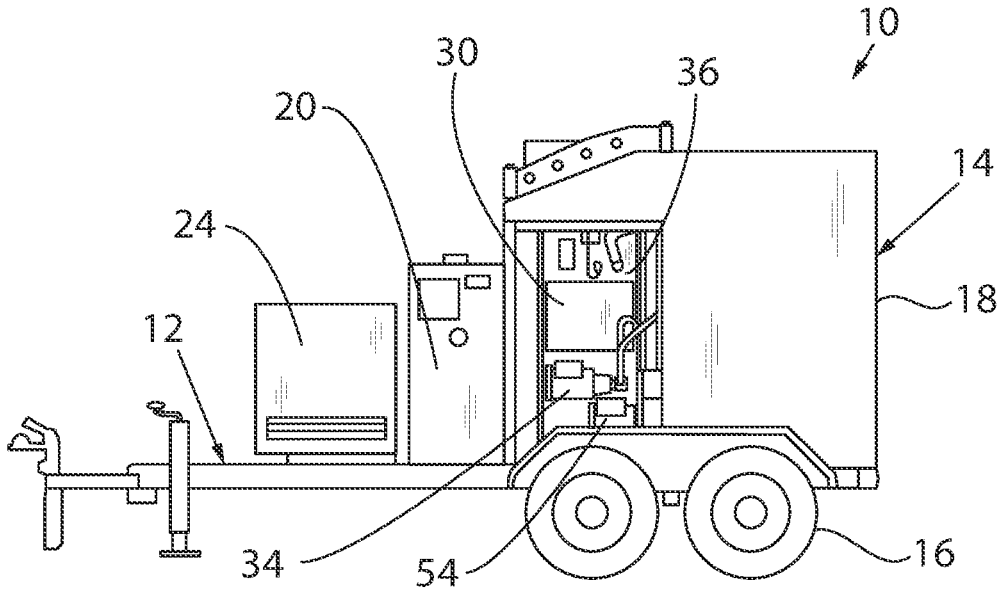
FIG. 2 is a partially cut-away, side-elevational view of the hydronic surface heater of FIG. 1.

With reference to the drawing figures, in FIGS. 1 and 2, a mobile heater 10 is illustrated that includes a hydronic surface heater 14 mounted on a trailer 12 that is supported on the ground by wheels 16. The surface heater 14 is encased in a housing 18 for enhanced environmental protection and security. A fuel tank 20 is mounted on the trailer 12 in front of the housing 18. The fuel tank 20 stores a liquid fuel, typically kerosene or No. 1 diesel fuel. Tank 20 typically has a capacity of on the order 200 gallons (750 L). An optional generator 24 is mounted on the trailer 12 in front of the fuel tank 20 for supplying electric power to the heater's electrical components and to tools, lights, and other equipment typically used while the heater 10 is present at a worksite. The generator 24 may be a 3 kw or 6 kw diesel generator and may be supplied with fuel from the tank 20. Alternatively, if the generator 24 is not present, electrical power may be supplied to the heater 14 via a cord plugged into a power main or a separate generator. Electronically controlled components of the surface heater 14 and generator are controlled by a controller 26 (FIG. 4).

Figure 3:
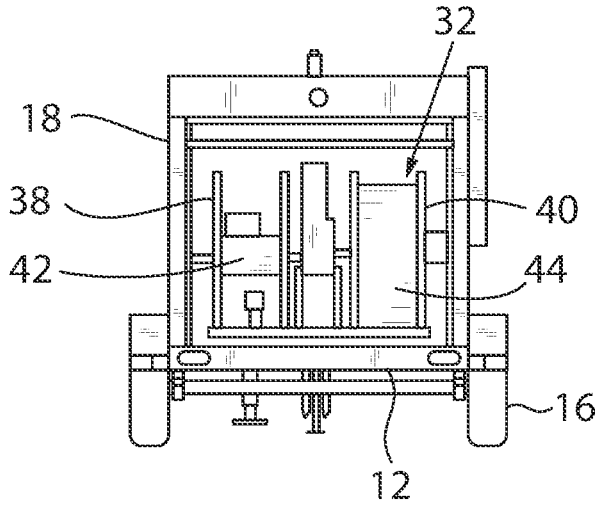
FIG. 3 is a partially cut-away rear view of the hydronic surface heater of FIGS. 1 and 2.
Figure 4:
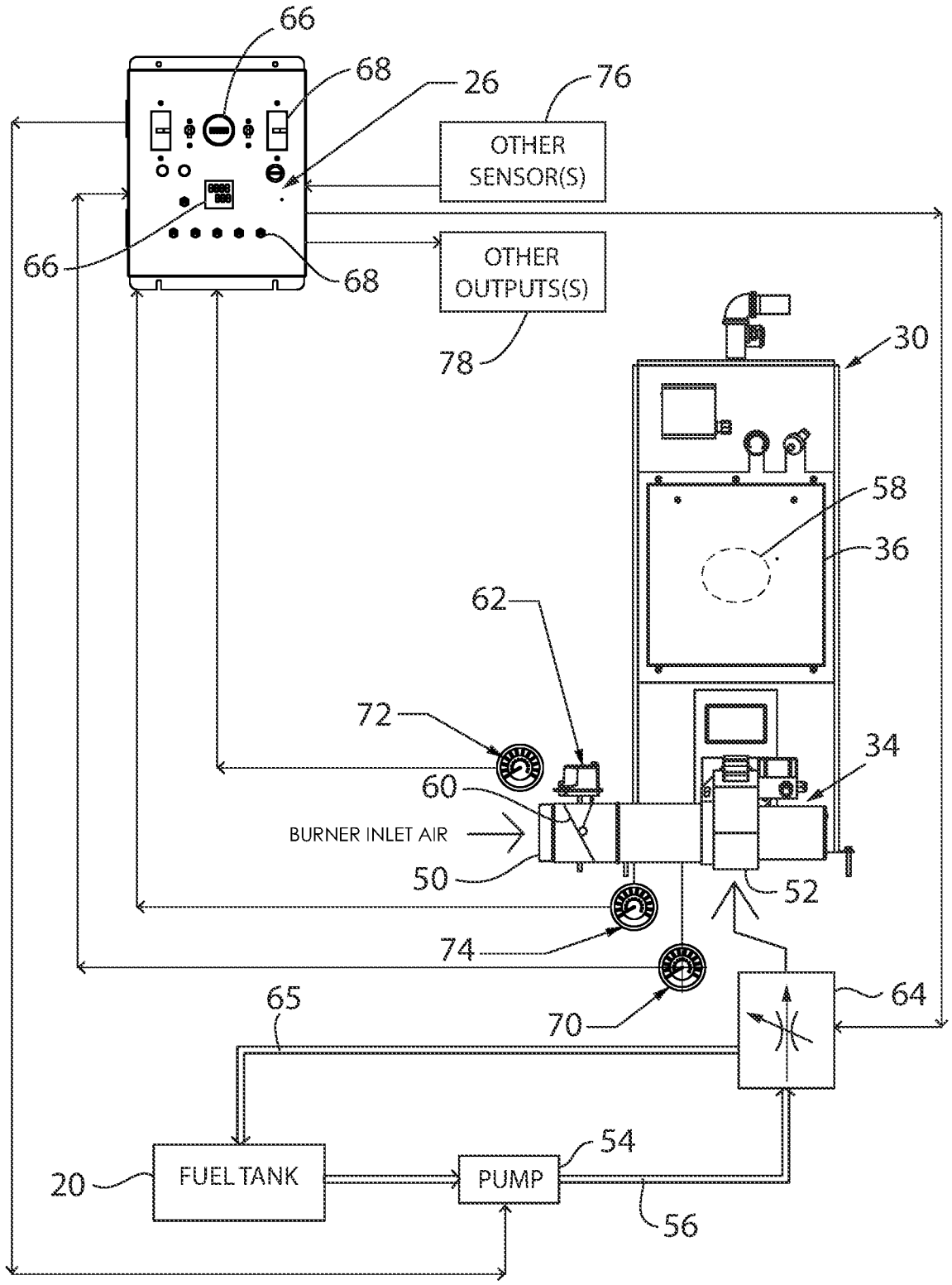
FIG. 4 is a schematic diagram of the air/fuel control system.

Referring to FIGS. 2-4, the surface heater 14 comprises a heater assembly 30 and a hydronic heating fluid supply assembly 32. Heater assembly 30 includes a burner 34, detailed below, and a tank or boiler 36 that stores a fluid heated by the burner 34. As best seen in FIG. 3, the hydronic fluid transfer assembly 32 includes two reels 38 and 40, each of which accommodates a respective hose 42, 44. Supply and return lines (not shown) couple the hoses 42 and 44 to the tank 36. Each hose 42 and 44 typically is on the order of 500 to 1000 ft (150 to 300 m), and, more typically, about 1500 ft (500 m) long. The fluid stored in the tank 36 and circulated through the hoses 42 and 44 may be, for example, a propylene glycol solution or another relatively viscous solution that remains liquid at temperatures as low as −40° F. (−40° C.).

Still referring to FIGS. 1-4, the burner 34 may be any burner of the type commonly used in hydronic heating devices. It typically a has rating of on the order of 0.5 to 1.0 M BTU/hour (150 to 300 kW), but the concepts disclosed herein are applicable to larger and smaller burners as well. Referring especially to FIG. 4, burner 34 includes an air inlet 50 connected to ambient air, a fuel inlet 52 connected to the fuel tank 20 via a pump 54 and a fuel supply line 56, a combustion chamber (not shown), and an exhaust outlet 58. Airflow through the air inlet 50 is regulated by a damper 60 whose opening and closing is controlled by a damper position adjuster 62 such as an electrically actuated motor coupled to the damper 60. Fuel flow through the fuel inlet 52 is controlled by an electronically actuated proportional control fuel supply valve 64 coupled to the fuel supply line 56 and a fuel return line 65. A suitable burner is available from a variety of manufacturers, such as R.W. Beckett Corp. All of these features, as well as the remainder of the burner may be standard.

In use, trailer 10 is towed to the worksite. The hoses 42, 44 are unwound from the reels 38 and 40 and arranged on the surface to be heated in a desired orientation. The generator 24, if present, is then started. Alternatively, if the generator 24 is not present, electrical power may be supplied to the heater 14 via a cord plugged into a power main or a separate generator. When the operator is ready to operate the machine 14, he or she interfaces with controller 26 to operate fuel pump 54 to supply fuel to the burner 34 from the tank 20. The heating fluid pump (not shown) then circulates heated liquid between the boiler 36 and the hoses 42 and 44, which warm the surface on which they are supported via indirect heat transfer.

The controller 26 is configured to operate a control device to alter the mass flow rate of air and/or fuel to the burner 34 to maintain a desired air/fuel ratio in the combustion chamber that is optimized for the fuel being supplied to the burner despite changes in ambient air temperature and/or ambient air pressure. That control device can be the damper actuator 62 and/or the fuel supply valve 64 in the illustrated embodiment. An initial, relatively rich air/fuel ratio typically is desired at startup, and a leaner air/fuel ratio typically is desired during steady state operation.

Pursuant to an embodiment of the invention, the controller 26 utilizes closed loop feedback to control the damper positioner 62 and/or the fuel supply valve 64 to maintain a parameter on which air/fuel ratio is dependent at a setpoint that maintains the desired air/fuel ratio at prevailing ambient air temperature and barometric pressure. The controller 26 also automatically adjusts this setpoint in response to sensed changes in ambient temperature and/or barometric pressure.

Referring now to FIG. 4, the controller 26 may be standard electronic control unit of the type commonly employed on industrial machines and, as such, includes a processor, RAM, and ROM. Controller 26 additionally includes one or more displays 66 and one or more user interfaces 68 in the form of, for example, switches, dials, and/or touch screens. One or more feedback sensors, such as an air mass flow rate sensor 70, can be used as feedback for controlling the damper position adjuster 62. Other sensors are provided for supplying data for determining the prevailing air/fuel ratio, or a parameter thereof. Such sensors may include an ambient (barometric) pressure sensor 72 and an air inlet temperature sensor 74. Other sensors may be provided instead or in addition to these sensors 70, 72, and 74. For example, the mass air flow sensor 70 could be replaced by or supplemented by an intake $O_2$ sensor and/or an exhaust $O_2$ sensor. All of these sensors provide data to the controller 26 over respective lines or signal wires.

Figure 5:
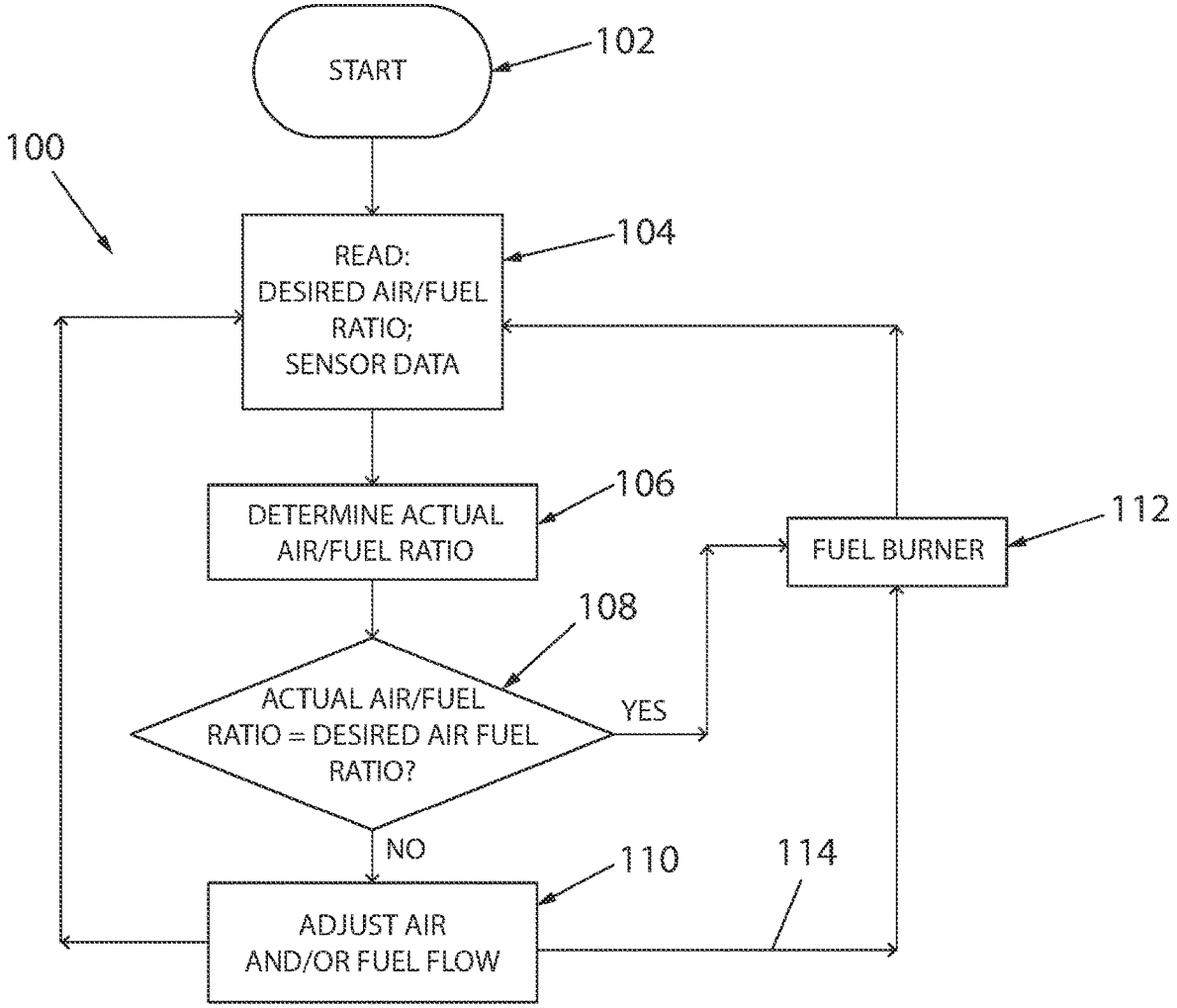
FIG. 5 is a flowchart showing a process for controlling the air/fuel control system of FIG. 4.

Turning now to FIG. 5, a process 100 is shown for controlling the supply of fuel and/or air to the burner 34 to maintain the air/fuel ratio in the burner at a desired level. The process 100 is implemented under control of the controller 26. In the specific example shown, the process maintains a controlled parameter at a setpoint that is empirically determined to achieve a desired air/fuel ratio despite changes in ambient air temperature and/or ambient air pressure. The controlled parameter is air mass flow rate in this specific example. However, as can be appreciated elsewhere in this disclosure, the controlled parameter could be any of a number of other parameters as well. The process 100 proceeds from START at block 102 to block 104 in which the desired air/fuel ratio and the data from the various sensors are read. The sensor data that is read at this time includes the data from some or all of the mass airflow sensor 70, ambient (barometric) pressure sensor 72, an air inlet temperature sensor 74, and possibly intake and/or exhaust $O_2$ sensors and other sensors. The desired air/fuel ratio could depend on the type of fuel being combusted. For example, No. 1 diesel fuel (kerosine) has about an 8% less BTU content than No. 2 diesel fuel, counselling for a corresponding selection of air/fuel ratio. This selection could be made in the field simply by interfacing with the controller 26 to select a fuel type when preparing the machine for operation. The desired air/fuel ratio may be read directly, or a value determinative of that ratio could be stored and read instead.

The air/fuel ratio read in block 102 also could be set to be different at startup when the burner 34 is cold than during steady state operation after the burner 34 warms up. For example, the controller 26 could be preprogrammed to run at a first, relatively rich air/fuel ratio during cold start and at a second, relatively lean air/fuel ratio after warmup. This initial air/fuel ratio could be preset and invariable. Alternatively, the initial air/fuel ratio could be determined based on prevailing environmental conditions. For example, through empirical testing, a map of "startup" desired air/fuel ratios for a range of ambient temperatures and pressures could be stored in the controller 100. The desired air/fuel ratio at each ambient temperature/pressure value could be one that strikes a desired balance between ignitability and emissions. The damper positioner 62 and/or fuel control valve 64 would then be controlled to operate at this air/fuel ratio until the burner reaches its steady state operating condition, whereupon the desired air/fuel ratio would change over to a different, likely leaner, air/fuel ratio. That steady state air/fuel ratio likely would be designated by the burner manufacturer, taking factors such as particulate emissions, NOx emissions, and efficiency into account. Changeover from the initial desired air/fuel ratio to the steady state desired air/fuel ratio could occur after elapsing of a preset time limit or based on signals from a burner temperature sensor (not shown).

It is also conceivable that burner operation could be controlled at one or more additional, intermediate desired air/fuel ratio as the burner 34 warms towards its steady state operation from a cold start. Such additional air/fuel ratio(s) could take burner-dependent parameters such as exhaust gas temperature into account.

The process 100 then moves to step 104, where the prevailing air/fuel ratio, or at least a controlled parameter indicative thereof, is determined. For example, the prevailing air/fuel ratio could be calculated using a known fuel flow rate, fuel energy content, air mass flow rate, air pressure, and air temperature. That determination can be simplified if the fuel flow rate is constant, meaning that the fuel flow control valve setting remains unchanged during air/fuel ratio control. In this case, air/fuel ratio can be adjusted by varying air mass flow rate based on detected changes in ambient air temperature and/or ambient air pressure. The determination of the required air mass flow rate for a given combination of ambient air temperature and ambient air pressure need not be made mathematically but, instead, can be made empirically using a mapping process generally as described above in connection with block 102. For example, the air mass that flows through the burner inlet 50 could be recorded at each of a number of combinations of ambient pressures and temperatures through a full range of damper settings and stored in the controller 26. That lookup table then could be used in block 106 to determine the air mass flow rate under prevailing ambient air temperature and pressure conditions that is required to obtain the desired air/fuel ratio. The actual air/fuel ratio could itself be determined at this time, if desired.

Next, in block 108, the actual air flow mass as monitored by sensor 70, is compared to the desired air flow mass as determined in block 106, which serves as a setpoint for air/fuel ratio control. If the two values match, air is supplied to the burner without changing the position of the air inlet damper 60 in block 112. If the two values do not match, the position of the damper 60 is adjusted in block 110 using data from the air mass flow sensor 70 as feedback. The damper position can be adjusted either through a fixed increment or by an amount dependent on the magnitude of the differential. The process 100 then returns to block 104, where the process is repeated. Arrow 114 confirms that burner operation will continue through the adjustment process.

It should be emphasized that air/fuel ratio parameters other than air mass flow rate could be used as controlled parameters. For example, as mentioned above, an intake $O_2$ sensor and/or an exhaust $O_2$ sensor could provide data usable as control points for damper adjustment. An exhaust gas sensor also could be used as an indicator of smoke or soot concentrations in the exhaust stream. High levels of soot indicate a rich air/fuel ratio while low levels indicate a lean mixture. Alternatively, it would be possible to measure the $O_2$ concentration in both the intake air and the exhaust gas stream to determine how much oxygen was burnt. It could also be possible to determine air/fuel ratio using a simple thermocouple in the exhaust stream. Specially, if one were to start with a lean air/fuel ratio and slowly increase the amount of fuel (or decrease the amount of air), the temperature in the exhaust gas will start to climb until stoichiometric combustion is achieved. A further increase in fuel (or decrease in air) will result in falling exhaust temperatures. If the machine were to determine the exhaust gas temperature peak, it would be able to set the machine a little richer than stoichiometric combustion. These inputs and possible alternative or supplemental controls that respond to them are collectively denoted by the "Other Sensor(s)" block 76 and "Other Output(s)" block 78 in FIG. 4.

Also, as should be apparent from the above, air/fuel ratio adjustment could be performed by control of the fuel supply valve 64 instead of or in addition to by control of the damper position adjuster 62. In this case, fuel mass flow would be used as a setpoint for air/fuel ratio control in addition to air mass flow. If both air mass flow and fuel mass flow are controlled, one parameter, such as air mass flow, could be used for coarse adjustment, and the other parameter (fuel mass flow in this example), could be used for fine adjustment with a range obtainable through coarse adjustment.

As should be apparent from the above discussion, control of the air damper position adjuster 62 and/or fuel flow control valve 64 also could be controlled at startup and/or during warmup using mass flow rate and/or fuel mass flow rate as setpoint(s) for the actuating the controlled device(s) 62 and 64.

It also should be noted that the embodiment described herein explains the best currently known mode of practicing the invention and will enable others skilled in the art to utilize the invention but should not be considered limiting. Rather, it should be understood that the invention is not limited to the details of construction and arrangements of the components as set forth but is capable of other embodiments and of being practiced or carried out in various ways.

We claim:

1. A surface heater; comprising:

a fuel tank;

a burner, the burner having a fuel inlet connected to the fuel tank and an air inlet;

a heat transfer system that directs a fluid heated by the burner to a surface to be heated;

at least one sensor transmitting an electrical signal providing data indicative of an air/fuel ratio in the burner; and an electronic controller that is coupled to the sensor and to the burner and that is configured, in response to electrical signals received from the sensor, to transmit electronic signals to at least one control device to actuate the at least one control device to control the supply of fuel and/or air to the burner to maintain a desired air/fuel ratio in the burner despite changes in ambient air temperature and/or ambient air pressure.

2. The surface heater of claim 1, wherein the surface heater comprises a mobile hydronic surface heater, and wherein the fluid that is heated by the burner comprises a liquid stored in a tank.

3. The surface heater of claim 1, wherein the control device comprises at least one of 1) an airflow rate adjuster that can be actuated by the electronic controller to adjust airflow through the inlet of the burner and 2) a fuel flow rate adjuster that can be actuated by the electronic controller to adjust fuel flow to the burner.

4. The surface heater of claim 3, wherein the electronic controller is configured to adjust the position of the control device using closed loop feedback to maintain a controlled parameter at a setpoint indicative of a desired air/fuel ratio at a prevailing ambient air temperature and/or an ambient air pressure.

5. The surface heater of claim 4, wherein the electronic controller is configured to store a map in a memory thereof that directly or indirectly indicates values of the controlled parameter at each of a plurality of combinations of ambient air temperatures and pressures.

6. The surface heater of claim 5, wherein the sensor is configured to directly or indirectly monitor a mass of air flowing into the burner and to provide an electrical signal indicative thereof to the electronic controller, and wherein the electronic controller is configured to use the electrical signal from the sensor as feedback to control the airflow rate adjuster to maintain the parameter at a setpoint.

7. The surface heater of claim 5, wherein the sensor comprises at least one of an air mass flow rate sensor, an intake $O_2$ sensor, and exhaust $O_2$ sensor, an exhaust gas composition sensor, and an exhaust gas temperature sensor.

8. The surface heater of claim 3, wherein control device comprises at least one of a damper that controls airflow through the inlet of the burner and a proportional control valve that controls fuel flow into the burner.

9. The surface heater of claim 1, wherein the electronic controller is configured to control for a first desired air/fuel ratio at burner startup and a second air/fuel ratio during steady state burner operation.

10. A surface heater, comprising:

a mobile support including wheels and a frame supported on the wheels;

a fuel tank supported on the mobile support;

a burner supported on the mobile support, the burner having a fuel inlet connected to the fuel tank and an air inlet;

a tank that is supported on the mobile support and that is configured to store a liquid that is heated by the burner;

at least one hose through which the liquid is configured to circulate between the burner and the surface to be heated, thereby heating the surface;

at least one sensor that generates and transmits an electrical signal providing data indicative of an air/fuel ratio in the burner; and an electronic controller that is coupled to the sensor and to the burner and that is configured, in response to signals received from the sensor, to transmit electronic signals to the at least one control device to actuate at least one control device to control the supply of fuel and/or air to the burner to maintain a controlled parameter at a setpoint in order to maintain a desired air/fuel ratio despite changes in prevailing ambient air temperature and ambient air pressure.

11. The surface heater of claim 10, wherein the control device comprises at least one of an airflow rate adjuster that can be actuated by the controller to adjust airflow through the inlet of the burner, and a fuel flow rate adjuster that can be actuated by the controller to adjust a rate of fuel flow into the burner.

12. The surface heater of claim 10, wherein the controller is configured to store a map that indicates an air/fuel ratio for each of a plurality of values of the controlled parameter at each of a plurality of combinations of ambient air temperatures and pressures.

13. The surface heater of claim 12, wherein the controlled parameter includes at least one of an airmass flow rate into the burner, an inlet $O_2$ concentration, an exhaust $O_2$ concentration, an exhaust gas composition, and an exhaust gas temperature, wherein the controller is configured to use a signal indicative of the controlled parameter as feedback to control the airflow rate adjuster and/or the fuel flow rate adjuster to maintain the setpoint controlled parameter.

14. The surface heater of claim 10, wherein the controller is configured to control for a first desired air/fuel ratio at burner startup and a second air/fuel ratio during steady state burner operation.

15. A method of operating a surface heater; the surface heater including a fuel tank, a burner having a fuel inlet connected to the fuel tank and having an air inlet, at least one sensor that transmits an electrical signal providing sensor data indicative of an air/fuel ratio in the burner, a heat transfer system that directs a fluid heated by the burner to a surface to be heated, the method comprising:

using an electronic controller, receiving signals from the sensor and, in response to the receipt of the electrical signals from the sensor, generating and transmitting electronic signals to the at least one control device to actuate the at least one control device to control the supply of fuel and/or air to the burner as a function of the sensor data to maintain a desired air/fuel ratio despite changes in prevailing ambient air temperature and/or an ambient air pressure.

16. The method of claim 15, wherein the actuating comprises actuating at least one of an airflow rate adjuster and a fuel flow rate adjuster.

17. The method of claim 15, wherein the adjusting is performed under action of a controller that utilizes a map that indicates a value of a controlled parameter at each of a plurality of combinations of ambient air temperatures and pressures.

18. The method of claim 17, further comprising monitoring the controlled parameter and using the monitored controlled parameter as feedback to control the airflow rate adjuster and/or the fuel flow rate adjuster to maintain the controlled parameter at the setpoint.

19. The method of claim 17, wherein the controlled parameter includes at least one of air mass flow rate, an intake $O_2$ concentration, an exhaust $O_2$ concentration, an exhaust gas composition, and an exhaust gas temperature.

20. The method of 15, wherein the adjusting maintains a first desired air/fuel ratio at burner startup and a second air/fuel ratio during steady state burner operation.

* * * * *